United States Patent [19]

Hanson

[11] 4,437,090

[45] Mar. 13, 1984

[54] APPARATUS FOR INDICATING CREOSOTE BUILDUP IN A CHIMNEY

[76] Inventor: R. Edward Hanson, 12 Dale St., Hallowell, Me. 04347

[21] Appl. No.: 221,781

[22] Filed: Dec. 31, 1980

[51] Int. Cl.[3] ..... G08B 21/00

[52] U.S. Cl. ..... 340/613; 98/58; 200/61.21; 340/617; 340/666; 177/46; 177/50

[58] Field of Search ..... 340/613, 617, 612, 666, 340/665; 177/46, 50; 98/58 R; 110/184; 200/85 R, 61.21

[56] References Cited

U.S. PATENT DOCUMENTS

| | | | |
|---|---|---|---|
| 842,554 | 1/1907 | Johnson | 200/85 R |
| 2,521,471 | 9/1950 | May | 200/85 R |
| 2,571,378 | 10/1951 | Parisi | 200/61.21 |
| 2,714,937 | 8/1955 | Houle | 98/58 |
| 2,879,708 | 3/1959 | Cripe | 200/85 R |
| 4,312,225 | 1/1982 | Williams | 340/617 |

FOREIGN PATENT DOCUMENTS

| | | | |
|---|---|---|---|
| 2377 | of 1883 | United Kingdom | 200/85 R |

*Primary Examiner*—John W. Caldwell, Sr.
*Assistant Examiner*—Daniel Myer

[57] ABSTRACT

In order to provide an indication of the extent to which creosote has built up in a chimney, an accumulator on which creosote will also build up is held suspended in a chimney in a zone where a major creosote buildup is anticipated. The accumulator is so connected to a normally open switch in a signal circuit that its weight and that of a predetermined creosote deposit thereon will close the switch, a signal is then energized to warn that the chimney should be cleaned or at least inspected.

12 Claims, 5 Drawing Figures

2
2
3
3
10
11
12
13
14
15
16
17
18
19
20
21
22
22
23
24
24A
25
26
27
28
28
29
30
31

APPARATUS FOR INDICATING CREOSOTE BUILDUP IN A CHIMNEY

BACKGROUND OF THE INVENTION

The ever increasing use of wood as a fuel has resulted in warnings to the public of the danger of chimney fires unless chimneys are cleaned from time-to-time.

When a chimney needs to be cleaned is, at the present time, essentially a matter of guess work unless it has been inspected by a qualified person. Many variables determine the rate at which creosote will build up in a chimney among which, by way of examples, are the frequency with which a chimney is used, whether or not the wood is properly seasoned and whether or not the stove, heater or furnace is of the air tight type.

Unless one were to incur the expense of chimney inspections on a regular basis, there is, as far as I am aware, now no way to determine when a chimney should be inspected and probably cleaned.

THE PRESENT INVENTION

The general objective of the present invention is to provide an indication that creosote has so built up in a chimney that it should be inspected to determine whether or not it is advisable then to clean it.

In accordance with the invention, this objective is attained with apparatus having an accumulator that, when suspended in a chimney in a zone where a major build up is anticipated, will also have creosote built up thereon with the buildup increasing the accumulator weight. The accumulator is suspended from the arm of a normally open, weight actuated switch attached to the chimney and in a circuit including a signal device energized when the switch is closed as it is when the creosote built up on the accumulator increases the suspended weight to a predetermined extent and located where the signal will attract attention.

An important objective of the invention is to enable the switch to be secured to the chimney quickly and easily, an objective attained by mounting the switch on a bracket with the attaching portion extending downwardly into the flue and with the switch positioned outside the chimney. The attaching portion is secured by an adjustable anchor extending transversely of and in engagement with opposite portions of the flue.

A further objective of the invention is to provide an accumulator on which creosote will be deposited and continue to build up to correspond to the buildup of creosote in the flue. This objective is attained with the accumulator having a rod to which discs are connected in a spaced apart relationship.

BRIEF DESCRIPTION OF THE DRAWINGS

The accompanying drawings illustrate a preferred embodiment of the invention of which

THE PREFERRED EMBODIMENT OF THE INVENTION

Figure 1:
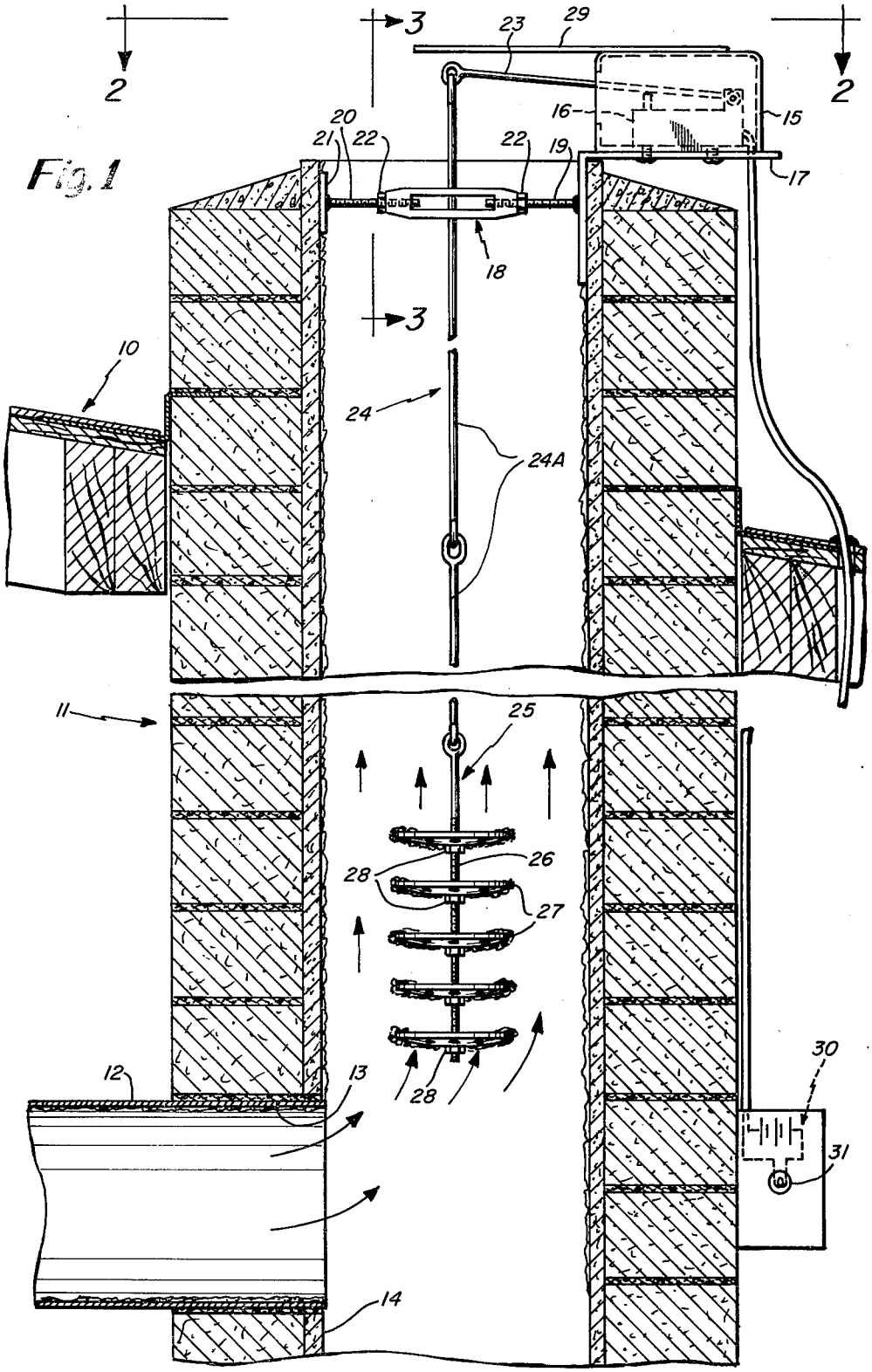
FIG. 1 is a section taken vertically of a chimney with an apparatus installation in accordance with the invention.
Figure 2:
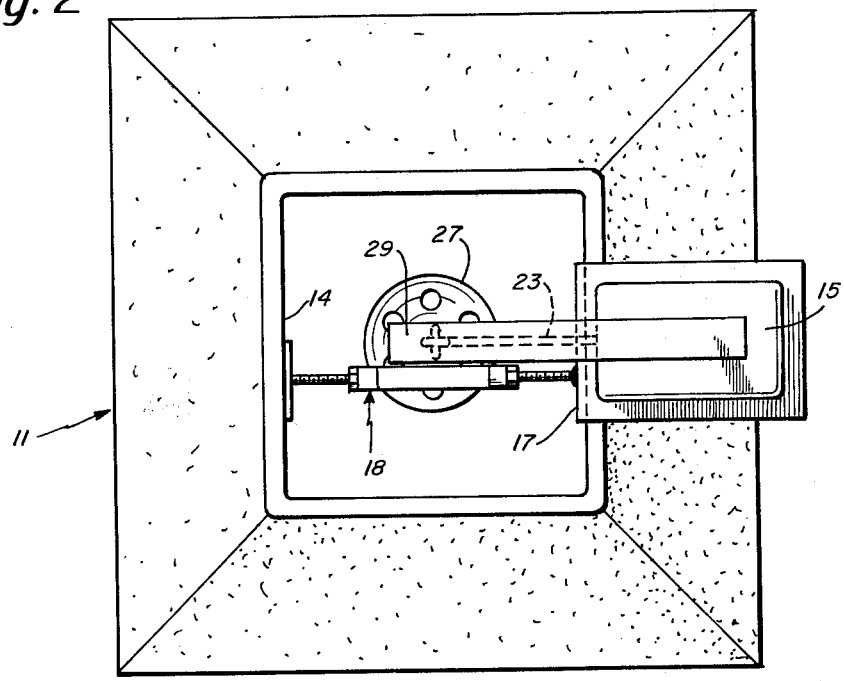
FIG. 2 is a top plan view thereof.
Figure 3:
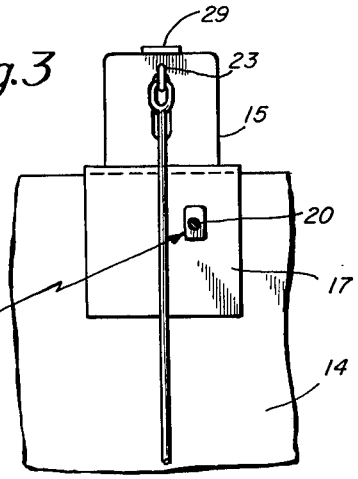
FIG. 3 is a section taken approximately along the indicated line 3—3 of FIG. 2.
Figure 4:
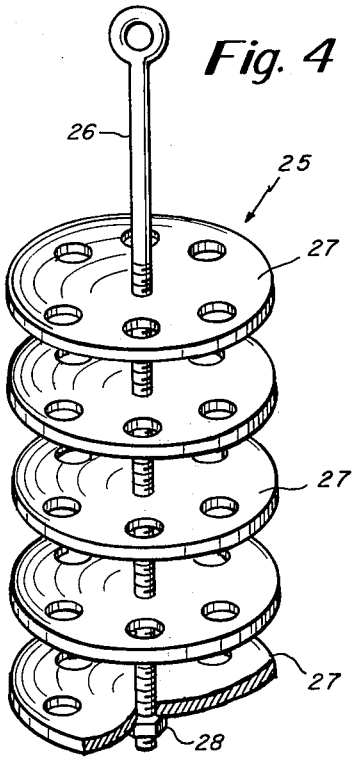
FIG. 4 is a perspective view, on an increase in scale, of the accumulator.

In FIG. 1, a building, generally indicated at 10, has a chimney 11 to the flue of which a stove, heater, or furnace, not shown is placed in communication by a length 12 of a stove pipe, fitted in an opening 13 through the outer brick wall and the inner lining 14.

In accordance with the invention, a housing 15 containing a normally open, weight responsive switch 16 is mounted on the shelf portion of a metal bracket 17 extending across one side of the cap of the chimney 11 with its attaching portion extending downwardly therein and anchored therein by a turnbuckle, generally indicated at 18. To enable such anchoring to be quickly and easily effected, the end of the threaded rod 19 of the turnbuckle is welded to the attaching portion of the bracket. The other rod 20 is shown as threaded, its threads of the hand opposite to those of the rod 19, has a pressure plate 21 welded thereto. With the bracket 17 in position, the turnbuckle 18 is easily adjusted to so lengthen it as to anchor the bracket securely in place. Desirably and as shown, each threaded end of the turnbuckle has a lock nut 22 threaded thereon.

The switch 16 is or may be of any presently available type and has its operating arm 23 of sufficient length to place its free end centrally of the flue. A member, generally indicated at 24 is pivotally connected to the free end of the switch arm 23 and extends downwardly through the flue with a creosote accumulator, generally indicated at 25, pivotally connected to the lower end of the suspending member 24 which is of a length such that the accumulator is held in a location where a major creosote buildup is anticipated. The member 24 is shown as consisting of a series of rods 24A having interconnected eyes at their ends.

The accumulator 25 is shown as consisting of a threaded rod 26 pivotally connected to the lower end of the lowermost rod 24A with a series of perforated discs 27 threaded thereon and spaced from each other. Each disc 27 is shown as backed by a lock nut 28. The discs 27 are preferably circular and so dimensioned that the accumulator does not affect the draft, and are shown as concavo-convex in shape with their concave surfaces disposed upwardly.

The accumulator is supported in the chimney in a position where the maximum buildup of creosote is expected to occur. The switch 16 is so adjusted that it is not closed until the weight suspended from the free end of the arm 23 increases to a predetermined extent, such added weight being that amount of creosote deposited on the discs 27 of the accumulator that indicates that the chimney should be inspected to determine whether or not it should be cleaned. In order that the switch cannot be actuated as by a bird lighting on the switch arm 23, the arm 23 is protected by an overlying bar 29 shown as attached to the switch housing 15.

The switch 16 is in a battery circuit 30 including a signal device, shown as a lamp 31 with the leads to and from the switch extending down the roof of the building and entering therein, along with television antenna leads, not shown, by way of example and not of limitation.

Figure 5:
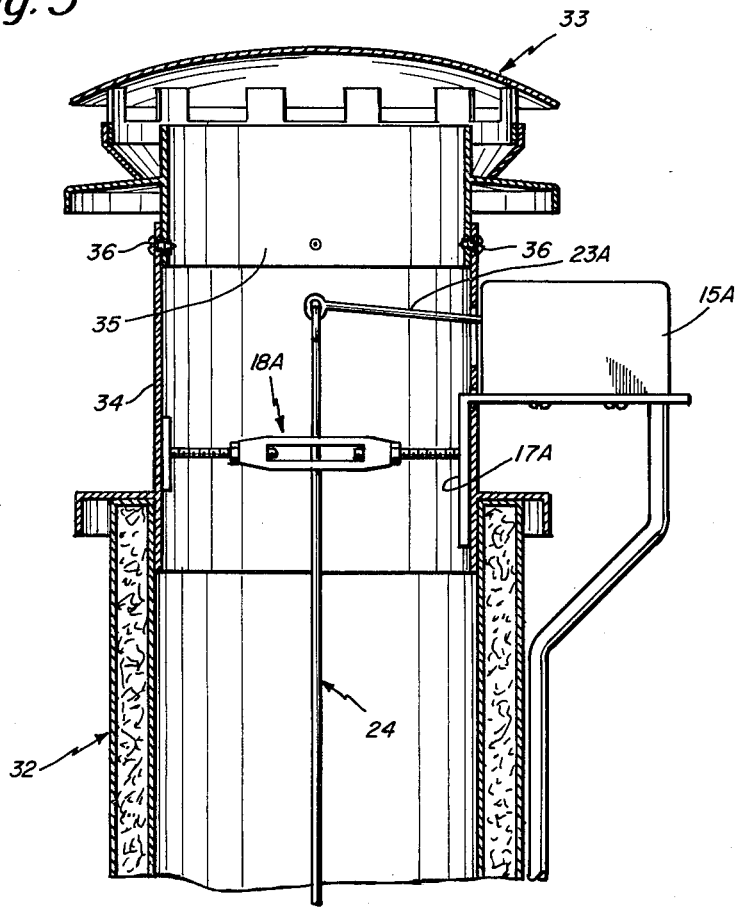
FIG. 5 is a section taken vertically through the upper end of an insulated metal chimney.

In the embodiment of the invention illustrated by FIG. 5, corresponding parts are identified by the appropriate reference numerals distinguished by the suffix addition A. In FIG. 5, the switch supporting bracket 17A is shown as attached to an insulated metal chimney 32 provided with a cap generally indicated at 33 of the type having a sleeve 34 secured as by cement to the chimney 32 with the cap also including a sleeve 35 fitting within the sleeve 34 and connected thereto by screws 36. With the screws 36 removed, the cap 33 detached and the sleeve 34 cut to enable the shelf portion of the bracket 17A to extend outwardly therethrough, the interior portion thereof is clamped to the sleeve 34 by means of the turnbuckle 18A. The sleeve 34 is also cut to enable the switch arm 23A to extend therein and with the switch housing 15A anchored to the shelf portion of the bracket and the switch arm 23A connected to the suspending member 24, the cap 33 is replaced and secured by the screws 36.

I claim:

1. Apparatus for indicating creosote in the flue of a chimney, said apparatus including an accumulator through which chimney flue gases will flow with creosote becoming deposited thereon when the accumulator is within the flow and the chimney in service, said accumulator of a cross sectional size and shape such that it may be a free fit within the flue without adversely affecting the draft therethrough, a normally open switch having an operating arm operable to effect the closing of the switch when a predetermined weight is applied to said arm, means to attach said switch to the upper end of the chimney, a suspending member connected to said arm and said accumulator when the switch is attached to said chimney, said connecting means then holding said accumulator centrally of the flue and in a position lengthwise thereof where a major buildup of creosote is anticipated, the weight of the accumulator and connecting means insufficient to effect the closing of said switch until creosote has built up on the surface of said accumulator to so increase said weight as to apply said weight, and a circuit including said switch and a warning signal operable when said circuit is closed by said switch.

2. The apparatus of claim 1 in which the accumulator includes a series of plates, and means interconnecting said plates in a spaced apart relationship.

3. The apparatus of claim 1 in which the accumulator includes a series of plates, a rod extending through said plates, said plates connected to said rod in a vertically spaced apart relationship, said rod connected to said suspending member.

4. The apparatus of claim 3 in which the plates are provided with a plurality of holes.

5. The apparatus of claim 4 in which the plates are discs.

6. The apparatus of claim 5 in which the discs are concavo-convex in shape, concave face uppermost.

7. The apparatus of claim 3 in which the rod is threaded and the plates are threaded thereon.

8. The apparatus of claim 3 in which the suspending member is pivotally connected to the switch arm.

9. The apparatus of claim 3 in which the suspending member includes a plurality of pivotally interconnected rods, each rod of the same length.

10. The apparatus of claim 1 in which the switch attaching means includes a bracket, one portion of the bracket disposable within the chimney and another portion then extending laterally thereof, and means operable to clamp said first named portion of the chimney wall.

11. The apparatus of claim 10 in which the clamping means is a turnbuckle.

12. The apparatus of claim 11 in which one end of a turnbuckle threaded rod is anchored to the first named portion of the bracket.

* * * * *